United States Patent [19]

Mittelmann

[11] Patent Number: 4,574,968

[45] Date of Patent: Mar. 11, 1986

[54] FREIGHT CONTAINER, IN PARTICULAR FOR AIR FREIGHT

[75] Inventor: Gerhard J. Mittelmann, Öhningen, Fed. Rep. of Germany

[73] Assignee: Swiss Aluminium Ltd., Chippis, Switzerland

[21] Appl. No.: 653,054

[22] Filed: Sep. 21, 1984

[30] Foreign Application Priority Data

Jul. 30, 1984 [DE] Fed. Rep. of Germany ..... 3428053

[51] Int. Cl.[4] ..... B65D 88/14

[52] U.S. Cl. ..... 220/1.5; 220/71; 220/84

[58] Field of Search ..... 220/1.5, 84, 71, 72; 244/118.1, 42.03 A; 296/1 S, 66, 168; 105/404, 409; 52/79.1

[56] References Cited

U.S. PATENT DOCUMENTS

| | | | |
|---|---|---|---|
| D. 217,232 | 4/1970 | Meller et al. | 220/1.5 X |
| 3,228,576 | 1/1966 | Gaukel | 224/42.03 A |
| 3,243,192 | 3/1966 | Franzel | 296/1.5 X |
| 3,572,252 | 3/1971 | Coover et al. | 105/409 X |
| 4,212,406 | 7/1980 | Mittelmann | 220/1.5 |
| 4,320,862 | 3/1982 | Bettenhausen | 296/1.5 X |

*Primary Examiner*—Allan N. Shoap

*Attorney, Agent, or Firm*—Bachman & LaPointe

[57] ABSTRACT

A freight container for air transport comprising a support frame structure disposed on a base plate and cladding means which at least partially clad the frame structure, wherein the side walls of the freight container are each delimited upwardly by a respective top member and both top members project beyond a common edge of the base plate and are respectively connected thereto by at least two members, is to be of such a configuration that, while providing a substantial reduction in weight, the stability of the structure is increased, while in addition permitting more advantageous storage and ease of assembly.

For that purpose, it is proposed that the side wall has a support frame comprising a vertical side member, the top member adjoining same and a member which is inclined outwardly from the base plate at an angle and which is attached to a projecting end of the overhanging top member. In that arrangement, a shaped panel is to be fixed as cladding means between the inclined members and a projection portion is to be formed out on the panel between marginal strip portions, the projection portion being provided with a bottom strip portion at a spacing with respect to the base plate.

8 Claims, 4 Drawing Figures

Fig.1
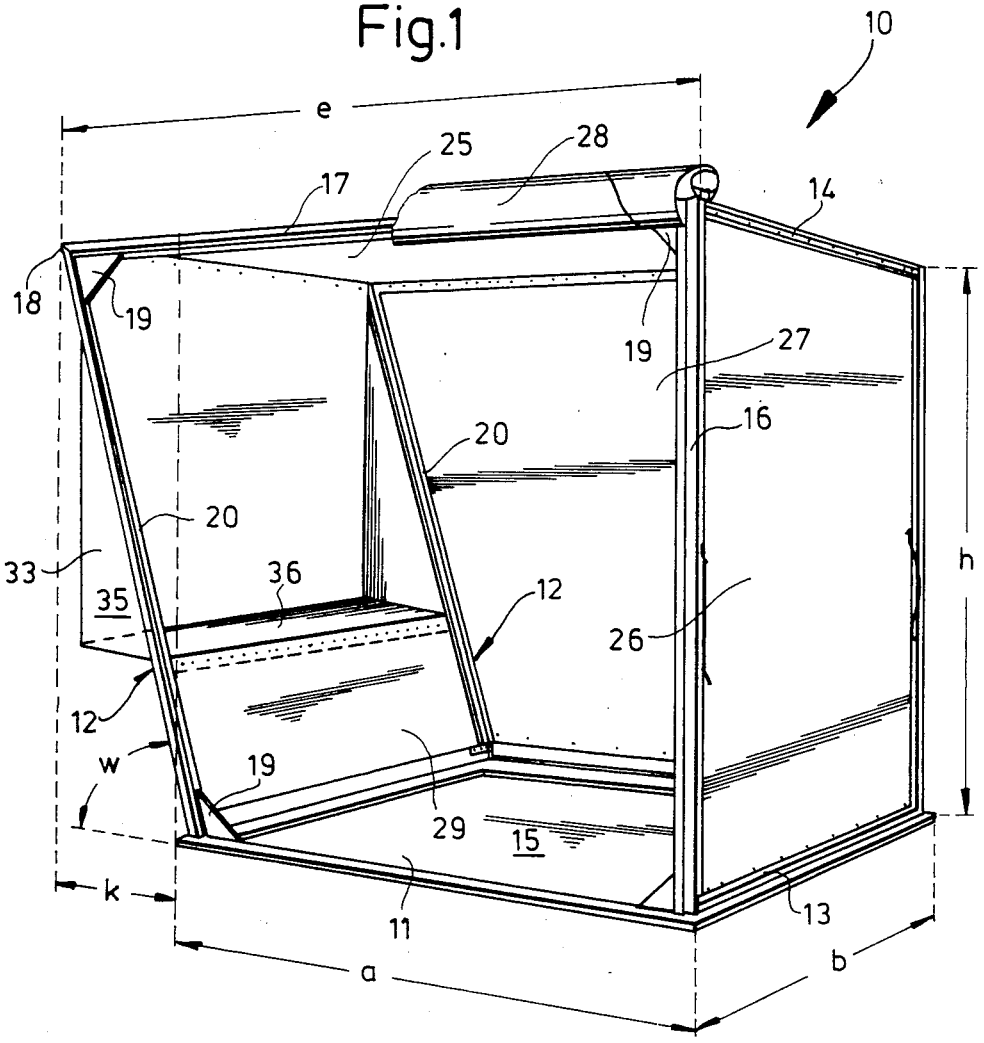
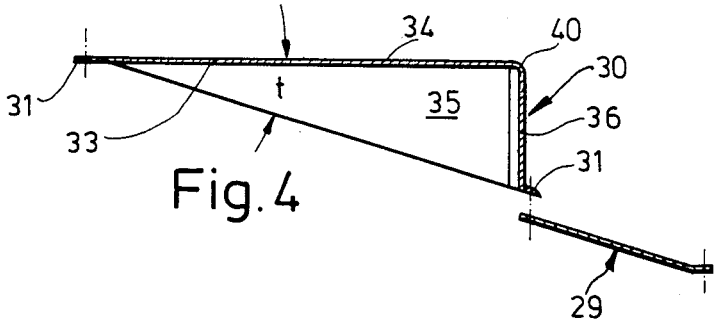
Fig. 4

FREIGHT CONTAINER, IN PARTICULAR FOR AIR FREIGHT

BACKGROUND OF THE INVENTION

The invention relates to a freight container, in particular for air transport, comprising a support frame structure which is arranged on a bottom or base plate and a covering which at least partially clads the support frame structure, wherein the side walls of the freight container are delimited upwardly by a respective top member and both top members project beyond a common edge of the base plate and are connected thereto each by at least two shaped members.

A freight container of that kind is to be found in DE-OS No 21 19 536. The side walls illustrated therein comprise two parallel vertical members which are connected by the top member; the outwardly projecting portion of the top member spans across a region of the side wall, which extends outside the base plate and which is bordered by frame members and which has an inclined edge, from the base plate to about the mid-height level of the side wall.

That form of freight container enables the container to be matched to the round or oval cross-section of an aircraft fuselage and is imperative for air freight containers.

It has been found that the above-discussed prior art construction suffers from the disadvantage that the rigid side frames frequently undergo deformation due to a thrust loading and in particular fracture phenomena occur outside the base plate, namely in the above-described additional region of the side wall. Another disadvantage is that freight containers of the above-described kind are comparatively high in weight, which is known to result in increased fuel consumption of aircraft.

Having regard to the foregoing considerations, the object set by the present inventor was that of so designing a freight container of the kind set forth in the opening part of this specification, that stability is enhanced, while substantially reducing the weight of the container, while in addition more advantageous storage and ease of assembly are achieved.

SUMMARY OF THE INVENTION

That object is attained in that the side wall has a support frame comprising a vertical side member, the top member which adjoins the side member and a member which is inclined outwardly at an angle from the base plate and which is attahced to a projecting end of the overhanging top member.

An angle of about 75° has been to be a particularly advantageous angle of inclination between the base plate and the inclined member.

In accordance with a further feature of the invention, a shaped panel member is fixed between the inclined frame members and a projection portion is formed thereon between marginal strip portions, said projection portion being provided with a bottom strip portion at a spacing from the base plate and having wedge-shaped side walls.

By virtue of that design configuration, a total of three members are sufficient to produce the support frame, which members can also be readily displaced with a parallelogram-like action by a force acting thereon, without fractures occurring; this arrangement does not have the additional end region of the side walls, for resisting such displacement, as in the prior-art construction.

In order nonetheless to provide the described stepped configuration, the shaped panel member is formed to project in the described manner and thus replaces the previous stepped configuration, without the heavy construction thereof. Shaped panel members of that kind can be readily produced from light metal or alloy sheet by a deep drawing process. However, it is also possible for such panel members to be made from plastic material.

The main surface of the shaped panel member or of the projection portion which is formed therefrom extends parallel to the oppositely disposed wall so that there is a right angle between the above-mentioned main surface and the bottom strip portion.

The shaped panel may be provided on the bottom strip portion with a bottom panel or plate which then extends as far as the base plate. In a particularly advantageous configuration, the bottom panel is separate from the shaped panel and is made from a somewhat stronger material, having regard to the higher loadings encountered in the base area of the structure.

Altogether, this air freight container complies with all requirements which arise on the one hand due to the need for high stability and on the other hand by virtue of the hope of low weight.

BRIEF DESCRIPTION OF THE INVENTION

Further advantages, features and details of the invention will be apparent from the following description of a preferred embodiment and with reference to the drawings in which:

FIG. 1 is a perspective view of a freight container in an open condition,

FIG. 4 shows a view in section along line IV—IV in FIG. 3, through parts thereof.

DETAILED DESCRIPTION

Figure 3:
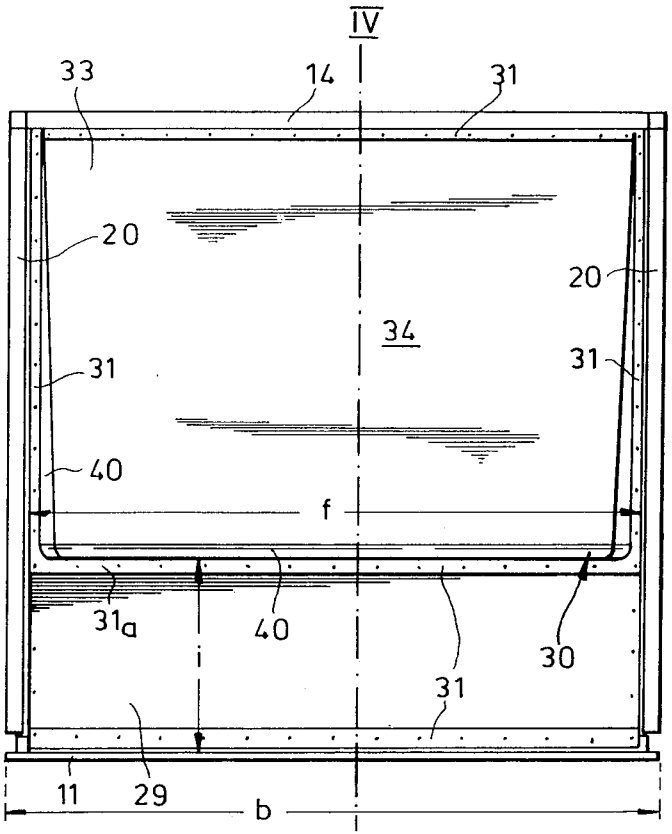
FIG. 3 shows a view at right angles to the view shown in FIG. 2.
Figure 2:
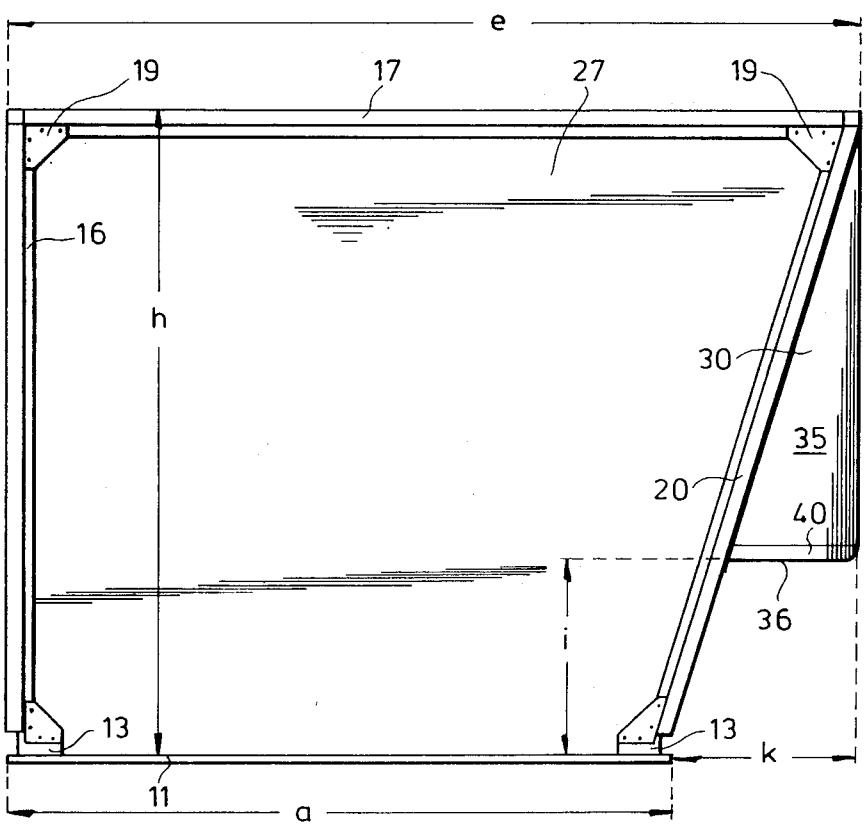
FIG. 2 shows a side view of the freight container.

A freight container 10, in particular for air transport, is provided, above a base plate 11 with a length a of for example 1562 mm and a width b of for example 1534 mm, with a support frame structure comprising two side frames 12 and transverse members 13 and 14 which connect the side frames 12. Each side frame 12 has a side member 16 which is vertical with respect to the surface 15 of the base plate 11, being of a height h of for example 1623 mm. Connected to the side member 16 is a respective ridge or top member 17 which is parallel to the above-mentioned surface 15. The top member 17 is for example 1980 mm in length (dimension e) and projects beyond the base plate 11 by an overhang dimension k of about 440 mm.

The projecting or cantilever end 18 of the top member 17 is connected by a shaped bar member 20 to the base plate 11, with the angle indicated at w between the bar member 20 and the plane defined by the surface 15 being 75°.

Corner plates or gussets for strengthening the connections between the members are denoted by reference numeral 19.

Mounted between the side frames 12 are a cover or top plate 25 and a front cladding panel 26 while there is a side wall member 27 in the side frame 12 which is at the rear in FIG. 1. The front side of the freight container is open and can be closed by a fabric door 28 which is shown in a rolled-up condition.

A bottom panel member 29 extends above the base plate 11 between the two inclined bar members 20, up to a height i which is approximately one third of the height h of the side members 16. A shaped panel 30 adjoins the base panel member 29, the width f of the panel 30 corresponding to the width of the base panel member 29. Both the base panel 29 and the shaped panel 30 are provided with rivet strip portions 31 extending therearound and are secured thereby to the transverse members 14 and 15 and the inclined bar members 20.

The base panel member 29 and the panel 30 are joined together at the other rivet strip portions 31*a*, being the fourth such portion on each of those panels.

A projection portion 33 is formed by a deep drawing process out of the panel 30 which is made of light metal or alloy, in such a way that the main surface 34 of the projection portion 33 encloses an angle t of 25° with the lateral rivet strip portions 31. Triangular surface portions 35 extend from the main surface 34 to the rivet strip portions 31, and there is a bottom strip portion 36 which joins the portion 35 and which extends normal to the main surface 34 and, in the position of installation, parallel to the base plate 11.

The transitions from the main surface 34 to the triangular surface portions 35 and to the bottom strip portion 36 are curved, as shown by the curved edge 40 that can be seen in FIG. 4.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A freight container, in particular for air freight, which comprises: a bottom or base plate; a support frame structure which is arranged on said base plate and includes side frames and top members extending therebetween, wherein top members project beyond the base plate at one end of the container by an overhang dimension and wherein the side frames extending from the top members to the base plate at the overhang dimension are sloped or inclined toward the other end of the container opposite said one end and the side frames extending from the top members to the base plate at said other end spaced from the overhang dimension are substantially vertical; a covering which at least partially clads the support frame and includes side wall members delimited upwardly by a top member, wherein one of said side wall members has a support structure including a vertical side frame, a top member and an inclined side frame, said container having another side wall member adjacent said one side wall member and sharing said inclined side frame, said another side wall member including a projection portion bounded by marginal portions, said projection portion having triangular side walls and a main surface extending parallel to the oppositely disposed wall of the freight container and including means for attaching said projection portion along the marginal portions to said container.

2. A freight container according to claim 1 wherein said marginal portions comprise marginal strip portions adjoined to the main surface and the triangular side walls and a bottom strip portion spaced from the base plate.

3. A freight container as set forth in claim 1 wherein the angle of inclination is about 75°.

4. A freight container as set forth in claim 2 wherein the angle of inclination between the marginal strip portions and the main surface of the projection portion and refined of the inclined side members is about 25°.

5. A freight container as set forth in claim 2 wherein the marginal strip portions are in the form of rivet or screw strip portions.

6. A freight container as set forth in claim 1 wherein extending between the inclined side frames is a base strip member which runs substantially parallel to the base plate.

7. A freight container as set forth in claim 1 including corner plate members between the top member and the members adjoining same.

8. A freight container as set forth in claim 1 wherein the support frame structure members are fixedly connected to the top members.

* * * * *

UNITED STATES PATENT AND TRADEMARK OFFICE

CERTIFICATE OF CORRECTION

PATENT NO. : 4,574,968

DATED : March 11, 1986

INVENTOR(S) : GERHARD J. MITTELMANN

It is certified that error appears in the above-identified patent and that said Letters Patent is hereby corrected as shown below:

Column, 4, claim 3, line 27, after "inclination" insert ---of the inclined side members.---.

Column 4, claim 4, line 31, change "refined of" to read ---defined by---.

Signed and Sealed this

*Twenty-second* Day of *July 1986*

[SEAL]

*Attest:*

DONALD J. QUIGG

*Attesting Officer*

*Commissioner of Patents and Trademarks*